United States Patent [19]

Blanchard

[11] Patent Number: 4,553,113

[45] Date of Patent: Nov. 12, 1985

[54] COMPACT DIFFERENTIAL COUPLER FOR MONOPULSE RADAR

[75] Inventor: Pierre Blanchard, Paris, France

[73] Assignee: Thomson CSF, Paris, France

[21] Appl. No.: 365,386

[22] Filed: Apr. 5, 1982

[30] Foreign Application Priority Data

Apr. 10, 1981 [FR] France ..... 8107205

[51] Int. Cl.[4] ..... H01P 5/20

[52] U.S. Cl. ..... 333/122; 343/786

[58] Field of Search ..... 343/16 M, 777, 786; 333/117, 113, 157, 248, 239, 121, 122; 29/600

[56] References Cited

U.S. PATENT DOCUMENTS

| | | | |
|---|---|---|---|
| 2,585,173 | 2/1952 | Riblet | 343/16 M |
| 2,759,154 | 8/1956 | Smith et al. | 343/7.4 |
| 2,973,487 | 2/1961 | Hanson et al. | 343/16 M |
| 3,274,604 | 9/1966 | Lewis | 333/122 X |
| 3,320,553 | 5/1967 | Howard | 343/786 |
| 3,530,483 | 9/1970 | Pierrot | 333/122 X |
| 3,643,261 | 2/1972 | Kenworthy et al. | 333/157 X |
| 3,883,877 | 5/1975 | Chabah et al. | 343/786 X |
| 4,210,880 | 7/1980 | Boujet et al. | 333/113 X |
| 4,473,828 | 9/1984 | Mörz et al. | 343/786 |

OTHER PUBLICATIONS

Doughty, D. J.; "Waveguide Components-A Survey of Methods of Manufacture and Inspection"; Journel Brit. IRE, Feb. 1961, pp. 169-189.

Montgomery, C. G.; "Technique of Microwave Measurement"; MIT Rad. Lab. Series; vol. 11, 1947, pp. 525-526.

*Primary Examiner*—Theodore M. Blum

*Assistant Examiner*—Gilberto Barrón, Jr.

*Attorney, Agent, or Firm*—Cushman, Darby & Cushman

[57] ABSTRACT

A compact differential coupler for a monopulse tracking radar constituted by four magic T's and comprising two metal members, which are symmetrical with respect to a plane $\pi$ and machined in such a way that their assembly by a set of screws constitutes the four T's, two of which are bent branch T's, a third a coaxial load T and the fourth a fork-type T.

8 Claims, 5 Drawing Figures

COMPACT DIFFERENTIAL COUPLER FOR MONOPULSE RADAR

BACKGROUND OF THE INVENTION

The present invention relates to a compact differential coupler for a monopulse radar.

As the accuracy and speed of measurement by the process of angular tracking by scanning are limited, the angular tracking process by monopulse was developed and consists of carrying out angular measurements, whilst processing each pulse back from the target with a multidirectional antenna. For example an antenna formed by a parabolic reflector and two identical horns positioned symmetrically with respect to the focus of the reflector is used.

Each horn is connected to a receiver. If the target is on the focal axis of the antenna, the signals received by the two receivers linked to the two horns are identical. However, if the target is not on the focal axis, the receivers linked with the two horns do not receive the same signals. The comparison of the signals received in each receiver must then make it possible to locate the target with respect to the focal axis, as a result of an appropriate processing of the signals.

In a monopulse tracking radar, the measurement of the angles must take place in site and in bearing. Thus, the antenna is organized to supply a sum channel, a site difference channel and a bearing difference channel.

The primary monopulse source in a monopulse antenna with amplitude comparison supplies four signals on four guides making it possible to carry out radar tracking, following processing of the said signals. Behind the said primary monopulse source is placed a differential coupler constituted by four magic T's grouped in accordance with the diagram of FIG. 1.

The source transmits four waves A, B, C and D respectively on the four channels 1, 2, 3 and 4 of the coupler. Channel $\epsilon$ receives the sum of the powers of the signals collected by the four channels 1 to 4: $A+B+C+D$. Channel $\Delta S$ effects the high-low difference $\Delta S$: $(A+B)-(C+D)$ and channel $\Delta G$ effects the right-left difference $\Delta G$: $(A+C)-(B+D)$. Thus, there is a planar problem for each of the site and bearing angular deviation measurements.

Emission takes place by channel $\epsilon$, the antenna then behaving like a single lobe antenna and reception takes place on the three channels $\epsilon$, $\Delta S$ and $\Delta G$. When the antenna is perfectly pointed toward the target channel $\epsilon$ receives a maximum power signal, whereas the difference channels $\Delta S$ and $\Delta G$ receive nothing. When there is a slight depointing, this signal received by channel $\epsilon$ is not significantly changed, but site and/or bearing depointing signals appear on channels $\Delta S$ and $\Delta G$ having a by no means negligible power.

As a function of their sign, it is known whether depointing has taken place in the upward or downward direction for the site difference channel $\Delta S$, and the right or left for the bearing difference channel $\Delta G$.

At present there are two types of construction of a differential coupler constituted by magic T's. According to the first type shown in FIG. 2, the magic T's 5, 6, 7 and 8 are produced separately and then assembled by connecting guides 9, and 10 and joining flanges 11, 12, 13 and 14. A differential coupler produced in this way has large dimensions due to the addition of the guides connecting the T's, is complicated as a result of the large number of parts to be machined and adjusted, and finally does not always have good decoupling characteristics because the symmetry of the parts and connections is not perfect, particularly due to the stray capacitances of the edges of the joining flanges.

According to the second constructional type of a differential coupler, the magic T's forming it are grouped by a mechanical brazing process making it possible to produce relatively small, but expensive assemblies. At the time of brazing, a significant amount of waste is produced and inevitably leads to deformations causing poor symmetry.

BRIEF SUMMARY OF THE INVENTION

To obviate these disadvantages, the present invention provides a compact differential coupler, constituted by four magic T's and which can be machined by a digitally controlled machine.

Therefore the present invention relates to a compact differential coupler for a monopulse radar constituted by four magic T's, wherein it comprises two metal members, which are symmetrical with respect to a plane $\pi$ and which are assembled facing one another along said plane of symmetry $\pi$ and are machined in such a way that their assembly constitutes the four magic T's, two of which are of the bent branch type, the third is of the coaxial load type and the fourth of the fork type.

According to another feature of the invention the coupler is constituted by two metal members, which are symmetrical with respect to a plane and can be entirely machined by a digitally controlled milling machine.

According to a third embodiment, the two metal members constituting the coupler are assembled by screws, a metal plate being placed between the two members in the plane of symmetry, level with the two bent branch-type magic T's.

BRIEF DESCRIPTION OF THE DRAWINGS

The invention is described in greater detail hereinafter relative to non-limitative embodiments and the attached drawings which, apart from FIG. 1 showing a general diagram of a coupler and FIG. 2 showing a construction of the coupler according to the prior art, show.

DETAILED DESCRIPTION OF THE PREFERRED EMBODIMENTS

Figure 1:
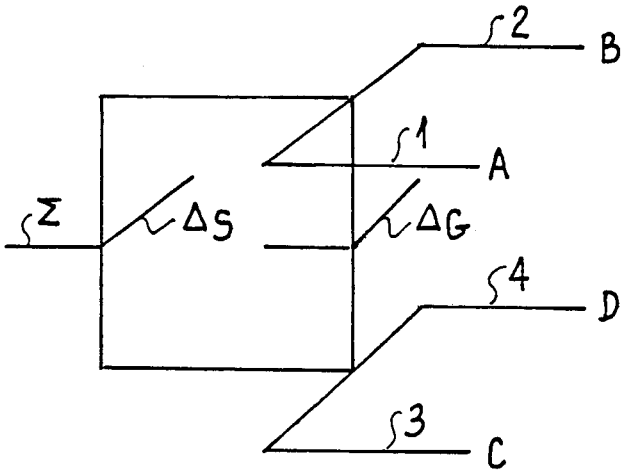
Figure 2:
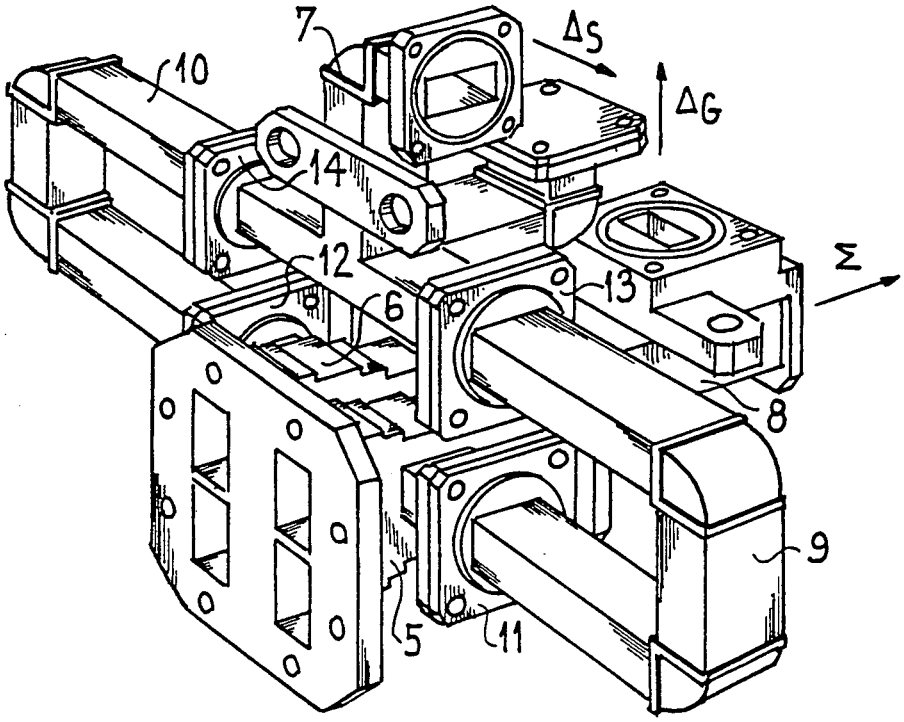
FIG 2 (PRIOR ART)
Figure 3:
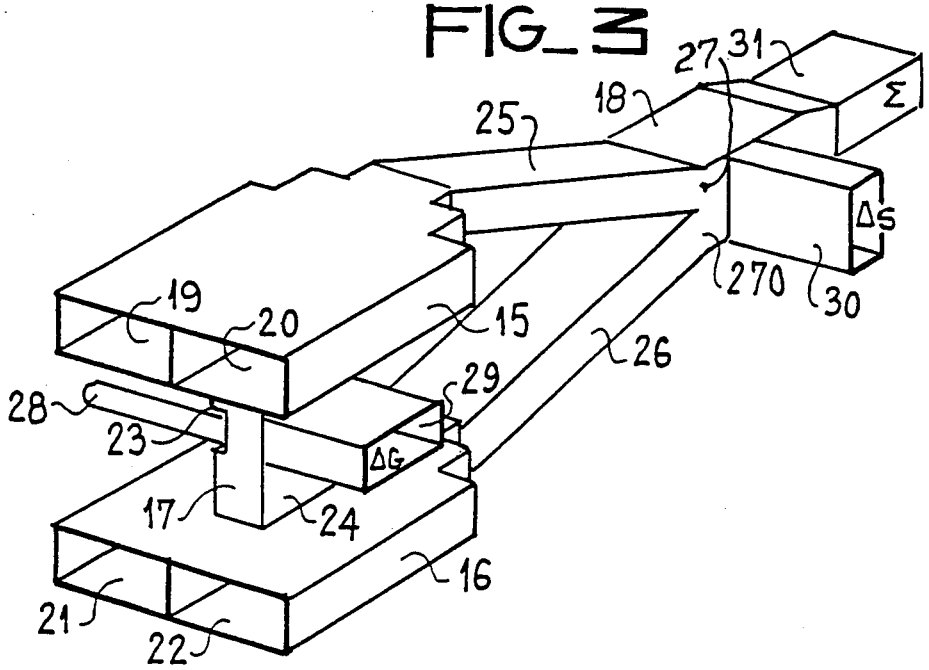
FIG. 3 a diagram of a compact differential coupler according to the invention.

FIG. 3 shows the diagram of a compact differential coupler according to the invention. It comprises two bent branch magic T's 15 and 16, one coaxial load magic T 17 and one fork-type magic T 18. Each of the T's 15 and 16 has two input channels, 19 and 20 for T 15 and 21 and 22 for T 16, and they are normally connected to the channels of a monopulse source associated with the coupler, as well as two output channels, one of these, 23 or 24, leading to the two input channels of the coaxial load T 17 and the other 25 or 26 is directly connected to the input channels 27 and 270 of the fork-type T 18. One of the two output channels of T 17 is loaded by a coaxial load 28 and its other output channel 29 realizes the bearing difference channel $\Delta G$ of the coupler. The fork-type T 18 realizes the site difference channel ΔS of the coupler and the other channel realizes the sum channel ϵ of the coupler.

Figure 4:
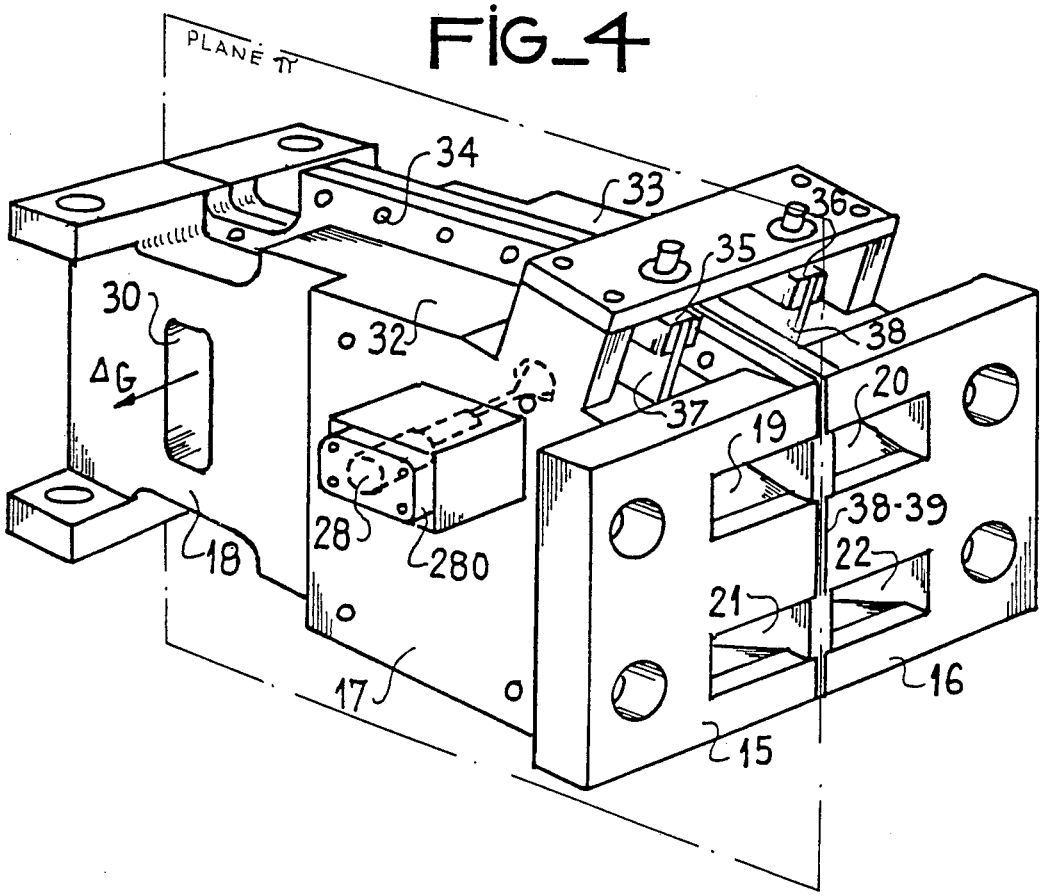
FIG. 4 a construction of a differential coupler according to the invention.

A construction of such a compact differential coupler is shown in FIG. 4. It mainly comprises the two metal members 32, 33, which are symmetrical with respect to a plane $\pi$ and are assembled along this plane by a set of screws 34. These two members are machined in such a way that the aforementioned four magic T's of the coupler are formed.

It is possible to see the two channels 19 and 20 for T 15 and 21 and 22 for T 16, which are connected to the channels of a monopulse source associated with the coupler. To ensure that these four channels 19 to 22 are exactly in phase at the coupler input, two phase shifters 35, 36 constituted by two dielectric plates 37, 38 are introduced to a greater or lesser depth into the channels. It is also possible to see the coaxial load 28 closing the output channel 280 of T 17 indicated in dotted line form, as well as channel 30 of T 18 corresponding to the bearing difference channel ΔG of the coupler.

Figure 5:
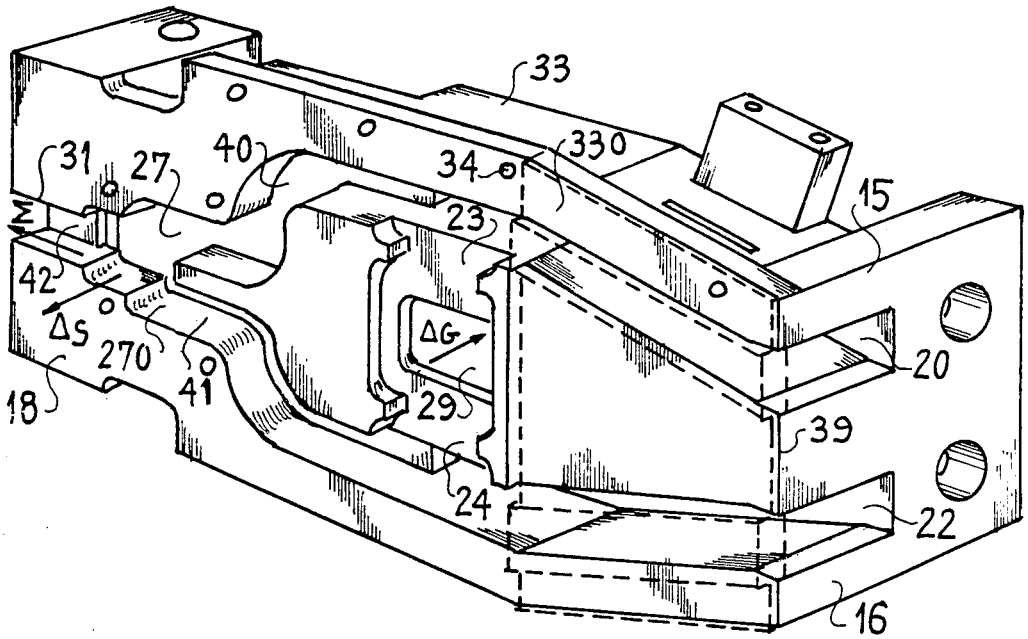
FIG. 5 one of the two metal members constituting the coupler according to the invention.

As can be seen in FIG. 5, channels 19 to 22 are constituted by cavities hollowed out of one of the sides of each of the two metal members 32 and 33. During their assembly for forming the coupler, it is necessary to place a metal plate 39 between the said two members in their plane of symmetry $\pi$. In order to separate the different channels, at the location of the channels plate 39 has a greater thickness, permitting its better adaptation to the cavities.

FIG. 5 shows one of the two main components of the coupler according to the invention, namely member 33. The components carrying the same references in FIGS. 4 and 5 are identical and perform the same functions. Member 33 has two cavities hollowed out from one of its sides and which are closed by the aforementioned metal plate 39, shown in dotted line form in the drawing, thus realizing the input channels 20 and 22 of T's 15 and 16. Perpendicular to the said channels are hollowed out two other cavities in each of the two members 32 and 33, forming, on assembly, channels 23 and 24 of the coaxial load T 17, whose output channel 29, constituting the bearing difference channel ΔG, is hollowed out from the entire thickness of member 33.

Output channels 25 and 26, diagrammatically shown in FIG. 3, of T's 15 and 16 are produced by joining cavities 40 and 41 hollowed out of the extension of channels 20 and 22 and similar cavities hollowed out of the other metal member 32, symmetrically with respect to plane $\pi$. These two channels 25 and 26 lead to two channels 27 and 270 of the fork-like T 18, whose output channel 31, forming the sum channel ϵ of the coupler, is constituted by the joining of a cavity 42 hollowed out of member 33 and a similar cavity symmetrical to plane $\pi$ hollowed out of member 32. The site difference channel ΔS of the coupler is produced through a cavity hollowed out perpendicular to plane $\pi$ through the entire thickness of member 32, which is not shown in the drawing.

Thus, a compact differential coupler for a monopulse radar constituted by four magic T's has been described and may be produced essentially on the basis of an assembly of two metal members, which are symmetrical with respect to a plane. Due to the quasi-symmetry of these two members, they can be machined by a digitally controlled milling machine, leading to a better productivity of this type of coupler.

The advantage of this production process results from the fact that a large part of the program of this machine is common to the construction of the two members, thus bringing about an excellent symmetry. The two members are assembled by a set of screws, thereby providing a monobloc assembly in which the connections between the four magic T's are very small so as to permit good decoupling and better technical performance levels with regards to the coupler. Finally, this construction is less costly than those of the prior art and makes it possible to obtain a compact coupler of small size and excellent reproducibility, in the frequency band "X", as well as for all bands above band "S".

I claim:

1. A compact differential coupler for a monopulse radar constituted by four magic T's, comprising two metal members which are symmetrical with respect to a plane $\pi$ and which are assembled facing one another along said plane of symmetry $\pi$ and are machined in such a way that their assembly constitutes the four magic T's, two of which are of the bent branch type, the third is of the coaxial load type and the fourth of the fork type said coaxial load type magic T being connected between said two bent branch type magic T's, and said bent branch type magic T's being connected to said fork type magic T.

2. A differential coupler according to claim 1, wherein the two bent branch magic T's are such that for each of them two channels are connected to the channels of a monopulse source with which the coupler is associated, a third channel is directly connected to the coaxial load magic T, at whose output is formed the bearing difference channel of the coupler and the fourth channel is directly connected to the two channels of the fork-type magic T, in whose two other channels are respectively formed the sum channel and the site difference channel of the coupler.

3. A differential coupler according to claim 2, wherein the channels of the bent branch magic T's are formed by four cavities respectively hollowed out from one of the sides, parallel to plane $\pi$, of each of the two members, symmetrically with respect to the plane $\pi$ and closed by a metal plate placed in the said plane of symmetry $\pi$.

4. A differential coupler according to claim 2, wherein the input channels of the coaxial load T are formed by two cavities hollowed respectively from one of the sides parallel to plane $\pi$ of each of the two members, perpendicular to the channels and symmetrically with respect to plane $\pi$.

5. A differential coupler according to claim 2, wherein one of the output channels of the coaxial load T is closed by a coaxial load, positioned perpendicularly with respect to plane $\pi$ and in the axis of the cavity forming the other output channel, corresponding to the bearing difference channel of the coupler.

6. A differential coupler according to claim 2, wherein the output channels respectively of the bent branch T's are formed by cavities hollowed respectively from one of the sides parallel to plane $\pi$ of each of the two members.

7. A differential coupler according to claim 3, wherein the two metal members are assembled by screws.

8. A method of producing a monopulse radar differential coupler having a first, second, third, and fourth input and a first, second, and third output and a coaxial load having two channels, from two quasi-symmetrical members comprising the steps of:

forming a first one of said members by:

(1) hollowing out a first and a second channel on one side of said first member to act as said first and said second input respectively;

(2) hollowing out a third and a fourth channel on said one side of said first member, perpendicular to said first and second channels, to act as one of said coaxial load channels;

(3) hollowing out a first hole on said one side of said first member between said third and said fourth channels to act as said first output;

(4) hollowing out a fifth and a sixth channel on said one side of said first member, said fifth and sixth channels being extensions of said first and said second channels respectively so that said fifth and sixth channels gradually converge at a first cavity; and (5) hollowing out a seventh channel on said one side of said first member, said seventh channel being connected to said first cavity to act as one half of said second output;

forming a second one of said members, including the steps of:

(6) hollowing out an eighth and ninth channel on one side of said second member to act as said third and said fourth input channel respectively;

(7) hollowing out a tenth and eleventh channel, on said one side of said second member, perpendicular to said eighth and ninth channels, to act as the second of said coaxial load channels;

(8) hollowing out a twelfth and a thirteenth channel on said one side of said second member, said twelth and thirteenth channels being extensions of said eighth and ninth channels respectively so that said twelfth and thirteenth channels gradually converge at a second cavity;

(9) hollowing out a second hole on said one side of said second member, said hole being connected to said second cavity to act as said third output;

(10) hollowing out a fourteenth channel on said one side of said second member, said fourteenth channel being connected to said second cavity to act as a second half of said second output;

placing a plate on said one side of said first or said second member so as to cover said first and said second channels or said eighth and said ninth channels; and joining said one side of said first and said second members to connect together said first and second halves of said second output form said coupler.

* * * * *